US011428050B2

(12) United States Patent
Rothe

(10) Patent No.: US 11,428,050 B2
(45) Date of Patent: Aug. 30, 2022

(54) REVERSE CIRCULATION HYBRID BIT

(71) Applicant: Baker Hughes, a GE company, LLC, Houston, TX (US)

(72) Inventor: Mitchell Rothe, Montgomery, TX (US)

(73) Assignee: Baker Hughes Holdings LLC, Houston, TX (US)

( * ) Notice: Subject to any disclaimer, the term of this patent is extended or adjusted under 35 U.S.C. 154(b) by 431 days.

(21) Appl. No.: 14/918,559

(22) Filed: Oct. 20, 2015

(65) Prior Publication Data

US 2016/0108680 A1 Apr. 21, 2016

Related U.S. Application Data

(60) Provisional application No. 62/066,324, filed on Oct. 20, 2014.

(51) Int. Cl.
*E21B 10/14* (2006.01)
*E21B 10/60* (2006.01)

(52) U.S. Cl.
CPC ..... *E21B 10/14* (2013.01); *E21B 10/60* (2013.01)

(58) Field of Classification Search
CPC ..... E21B 10/08; E21B 10/18; E21B 10/42; E21B 10/43; E21B 10/60; E21B 10/14
See application file for complete search history.

(56) References Cited

U.S. PATENT DOCUMENTS 930,759 A 8/1909 Hughes
1,388,424 A 9/1921 George
1,394,769 A 10/1921 Sorensen
1,519,641 A 12/1924 Thompson
1,537,550 A 5/1925 Reed
1,729,062 A 9/1929 Bull
1,801,720 A 4/1931 Bull
1,816,568 A 7/1931 Carlson
1,821,474 A 9/1931 Mercer
1,874,066 A 8/1932 Scott et al.
1,879,127 A 9/1932 Schlumpf
1,896,243 A 2/1933 MacDonald
1,932,487 A 10/1933 Scott
2,030,722 A 2/1936 Scott
2,117,481 A 5/1938 Howard et al.
2,119,618 A 6/1938 Zublin
(Continued)

FOREIGN PATENT DOCUMENTS

DE 1301784 8/1969
EP 0225101 6/1987
(Continued)

OTHER PUBLICATIONS

Dantinne, P, International Search Report for International Patent Application No. PCT/US2015/032230, European Patent Office, dated Nov. 16, 2015.
(Continued)

*Primary Examiner* — Christopher J Sebesta
(74) *Attorney, Agent, or Firm* — TraskBritt

(57) ABSTRACT

A hybrid rotary drill bit having at least one fixed blade and at least one rolling cutter assembly is configured for reverse fluid flow from an annulus, through junk slots and into a fluid pathway system located substantially centrally to a bit body. The fluid pathway system may be located underneath a portion of the at least one fixed blade.

16 Claims, 6 Drawing Sheets

(56) References Cited

U.S. PATENT DOCUMENTS 2,184,067 A 12/1939 Zublin
2,198,849 A 4/1940 Waxler
2,204,657 A 6/1940 Clyde
2,216,894 A 10/1940 Stancliff
2,244,537 A 6/1941 Kammerer
2,297,157 A 9/1942 McClinton
2,318,370 A 5/1943 Burch
2,320,136 A 5/1943 Kammerer
2,320,137 A 5/1943 Kammerer
2,358,642 A 9/1944 Kammerer
2,380,112 A 7/1945 Kinnear
2,533,259 A 6/1946 Woods et al.
2,520,517 A 8/1950 Taylor
2,533,258 A 12/1950 Morlan et al.
2,557,302 A 6/1951 Maydew
RE23,416 E 10/1951 Kinnear
2,575,438 A 11/1951 Arthur et al.
2,628,821 A 2/1953 Arthur et al.
2,661,931 A 12/1953 Swart
2,719,026 A 9/1955 Boice
2,725,215 A 11/1955 Macneir
2,815,932 A 12/1957 Wolfram
2,994,389 A 8/1961 Bus, Sr.
3,010,708 A 11/1961 Hlinsky et al.
3,039,503 A 6/1962 Mainone
3,050,293 A 8/1962 Hlinsky
3,055,443 A 9/1962 Edwards
3,066,749 A 12/1962 Hildebrandt
3,126,066 A 3/1964 Williams, Jr.
3,126,067 A 3/1964 Schumacher, Jr.
3,174,564 A 3/1965 Morlan
3,239,431 A 3/1966 Raymond
3,250,337 A 5/1966 Demo
3,269,469 A 8/1966 Kelly, Jr.
3,387,673 A 6/1968 Thompson
3,397,751 A 8/1968 Reichmuth
3,424,258 A 1/1969 Nakayama
3,583,501 A 6/1971 Aalund
3,760,894 A 9/1973 Pitifer
RE28,625 E 11/1975 Cunningham
4,006,788 A 2/1977 Garner
4,108,259 A 8/1978 Dixon et al.
4,140,189 A 2/1979 Garner
4,187,920 A * 2/1980 Johnson ..... E21B 10/18 175/215
4,190,126 A 2/1980 Kabashima
4,190,301 A 2/1980 Lachonius et al.
4,187,922 A 12/1980 Phelps
4,260,203 A 4/1981 Garner
4,270,812 A 6/1981 Thomas
4,285,409 A 8/1981 Allen
4,293,048 A 10/1981 Kloesel, Jr.
4,314,132 A 2/1982 Porter
4,320,808 A 3/1982 Garrett
4,343,371 A 8/1982 Baker, III et al.
4,359,112 A 11/1982 Garner et al.
4,359,114 A 11/1982 Miller et al.
4,369,849 A 1/1983 Parrish
4,386,669 A 6/1983 Evans
4,408,671 A 10/1983 Munson
4,410,284 A 10/1983 Herrick
4,428,687 A 1/1984 Zahradnik
4,444,281 A 4/1984 Schumacher, Jr. et al.
4,448,269 A 5/1984 Ishikawa et al.
4,456,082 A 6/1984 Harrison
4,468,138 A 8/1984 Nagel
4,527,637 A 7/1985 Bodine
4,527,644 A 7/1985 Allam
4,572,306 A 2/1986 Dorosz
4,600,064 A 7/1986 Scales et al.
4,627,882 A 12/1986 Soderstrom
4,641,718 A 2/1987 Bengtsson
4,657,091 A 4/1987 Higdon
4,664,705 A 5/1987 Horton et al.
4,690,228 A 9/1987 Voelz et al.
4,706,765 A 11/1987 Lee et al.
4,726,718 A 2/1988 Meskin et al.
4,727,942 A 3/1988 Galle et al.
4,729,440 A 3/1988 Hall
4,738,322 A 4/1988 Hall et al.
4,756,631 A 7/1988 Jones
4,763,736 A 8/1988 Varel
4,765,205 A 8/1988 Higdon
4,802,539 A 2/1989 Hall et al.
4,819,703 A 4/1989 Rice et al.
4,823,890 A * 4/1989 Lang ..... E21B 21/10 137/515
4,825,964 A 5/1989 Rives
4,865,137 A 9/1989 Bailey et al.
4,874,047 A 10/1989 Hixon
4,875,532 A 10/1989 Langford, Jr.
4,880,068 A 11/1989 Bronson
4,892,159 A 1/1990 Holster
4,892,420 A 1/1990 Kruger
4,915,181 A 4/1990 Labrosse
4,932,484 A 6/1990 Warren et al.
4,936,398 A 6/1990 Auty et al.
4,943,488 A 7/1990 Sung et al.
4,953,641 A 9/1990 Pessier
4,976,324 A 12/1990 Tibbitts
4,981,184 A 1/1991 Knowlton et al.
4,984,643 A 1/1991 Isbell et al.
4,991,671 A 2/1991 Pearce et al.
5,016,718 A 5/1991 Tandberg
5,027,912 A 7/1991 Juergens
5,027,914 A 7/1991 Wilson
5,028,177 A 7/1991 Meskin et al.
5,030,276 A 7/1991 Sung et al.
5,037,212 A 8/1991 Justman et al.
5,049,164 A 9/1991 Horton et al.
5,092,687 A 3/1992 Hall
5,116,568 A 5/1992 Sung et al.
5,137,097 A 8/1992 Fernandez
5,145,017 A 9/1992 Holster et al.
5,176,212 A 1/1993 Tandberg
5,199,516 A 4/1993 Fernandez
5,224,560 A 7/1993 Fernandez
5,238,074 A 8/1993 Tibbitts et al.
5,253,939 A 10/1993 Hall
5,287,936 A 2/1994 Grimes et al.
5,289,889 A 3/1994 Gearhart et al.
5,337,843 A 8/1994 Torgrimsen et al.
5,342,129 A 8/1994 Dennis et al.
5,346,026 A 9/1994 Pessier et al.
5,351,770 A 10/1994 Cawthorne et al.
5,361,859 A 11/1994 Tibbitts
5,429,200 A 7/1995 Blackman et al.
5,439,067 A 8/1995 Huffstutler
5,439,068 A 8/1995 Huffstutler et al.
5,452,771 A 9/1995 Blackman et al.
5,467,836 A 11/1995 Grimes et al.
5,472,057 A 12/1995 Winfree
5,472,271 A 12/1995 Bowers et al.
5,494,123 A 2/1996 Nguyen
5,513,715 A 5/1996 Dysart
5,518,077 A 5/1996 Blackman et al.
5,531,281 A 7/1996 Murdock
5,547,033 A 8/1996 Campos, Jr.
5,553,681 A 9/1996 Huffstutler et al.
5,558,170 A 9/1996 Thigpen et al.
5,560,440 A 10/1996 Tibbitts
5,570,750 A 11/1996 Williams
5,593,231 A 1/1997 Ippolito
5,595,255 A 1/1997 Huffstutler
5,606,895 A 3/1997 Huffstutler
5,624,002 A 4/1997 Huffstutler
5,641,029 A 6/1997 Beaton et al.
5,644,956 A 7/1997 Blackman et al.
5,655,612 A 8/1997 Grimes et al.
D384,084 S 9/1997 Huffstutler et al.
5,695,018 A 12/1997 Pessier et al.
5,695,019 A 12/1997 Shamburger, Jr.
5,755,297 A 5/1998 Young et al.
5,839,526 A 11/1998 Cisneros et al.

(56) References Cited

U.S. PATENT DOCUMENTS 5,862,871 A 1/1999 Curlett
5,868,502 A 2/1999 Cariveau et al.
5,873,422 A 2/1999 Hansen et al.
5,941,322 A 8/1999 Stephenson et al.
5,944,125 A 8/1999 Byrd
5,967,246 A 10/1999 Caraway et al.
5,979,576 A 11/1999 Hansen et al.
5,988,303 A 11/1999 Arfele
5,992,542 A 11/1999 Rives
5,996,713 A 12/1999 Pessier et al.
6,045,029 A 4/2000 Scott
6,068,070 A 5/2000 Scott
6,092,613 A 7/2000 Caraway et al.
6,095,265 A 8/2000 Alsup
6,109,375 A 8/2000 Tso
6,116,357 A 9/2000 Wagoner et al.
6,170,582 B1 1/2001 Singh et al.
6,173,797 B1 1/2001 Dykstra et al.
6,190,050 B1 2/2001 Campbell
6,209,185 B1 4/2001 Scott
6,220,374 B1 4/2001 Crawford
6,241,034 B1 6/2001 Steinke et al.
6,241,036 B1 6/2001 Lovato et al.
6,250,407 B1 6/2001 Karlsson
6,260,635 B1 7/2001 Crawford
6,279,671 B1 8/2001 Panigrahi et al.
6,283,233 B1 9/2001 Lamine et al.
6,296,069 B1 10/2001 Lamine et al.
RE37,450 E 11/2001 Deken et al.
6,345,673 B1 2/2002 Siracki
6,360,831 B1 3/2002 Akesson et al.
6,367,568 B2 4/2002 Steinke et al.
6,386,302 B1 5/2002 Beaton
6,401,844 B1 6/2002 Doster et al.
6,405,811 B1 6/2002 Borchardt
6,408,958 B1 6/2002 Isbell et al.
6,415,687 B2 7/2002 Saxman
6,427,791 B1 8/2002 Glowka
6,427,798 B1 8/2002 Imashige
6,439,326 B1 8/2002 Huang et al.
6,446,739 B1 9/2002 Richman et al.
6,450,270 B1 * 9/2002 Saxton ..... E21B 10/18 175/339
6,460,635 B1 10/2002 Kalsi et al.
6,474,424 B1 11/2002 Saxman
6,510,906 B1 1/2003 Richert et al.
6,510,909 B2 1/2003 Portwood et al.
6,527,066 B1 3/2003 Rives
6,533,051 B1 3/2003 Singh et al.
6,544,308 B2 4/2003 Griffin et al.
6,561,291 B2 5/2003 Xiang
6,562,462 B2 5/2003 Griffin et al.
6,568,490 B1 5/2003 Tso et al.
6,581,700 B2 6/2003 Curlett et al.
6,585,064 B2 7/2003 Griffin et al.
6,589,640 B2 7/2003 Griffin et al.
6,592,985 B2 7/2003 Griffin et al.
6,601,661 B2 8/2003 Baker et al.
6,601,662 B2 8/2003 Matthias et al.
6,637,528 B2 10/2003 Nishiyama et al.
6,684,966 B2 2/2004 Lin et al.
6,684,967 B2 2/2004 Mensa-Wilmot et al.
6,729,418 B2 5/2004 Slaughter, Jr. et al.
6,739,214 B2 5/2004 Griffin et al.
6,742,607 B2 6/2004 Beaton
6,745,858 B1 6/2004 Estes
6,749,033 B2 6/2004 Griffin et al.
6,797,326 B2 9/2004 Griffin et al.
6,823,951 B2 11/2004 Yong et al.
6,843,333 B2 1/2005 Richert et al.
6,861,098 B2 3/2005 Griffin et al.
6,861,137 B2 3/2005 Griffin et al.
6,878,447 B2 4/2005 Griffin et al.
6,883,623 B2 4/2005 McCormick et al.
6,902,014 B1 6/2005 Estes
6,922,925 B2 8/2005 Watanabe et al.
6,986,395 B2 1/2006 Chen
6,988,569 B2 1/2006 Lockstedt et al.
7,096,978 B2 8/2006 Dykstra et al.
7,111,694 B2 9/2006 Beaton
7,128,173 B2 10/2006 Lin
7,137,460 B2 11/2006 Slaughter, Jr. et al.
7,152,702 B1 12/2006 Bhome et al.
7,197,806 B2 4/2007 Boudreaux et al.
7,198,119 B1 4/2007 Hall et al.
7,234,549 B2 6/2007 McDonough et al.
7,234,550 B2 6/2007 Azar et al.
7,270,196 B2 9/2007 Hall
7,281,592 B2 10/2007 Runia et al.
7,292,967 B2 11/2007 McDonough et al.
7,311,159 B2 12/2007 Lin et al.
7,320,375 B2 1/2008 Singh
7,341,119 B2 3/2008 Singh
7,350,568 B2 4/2008 Mandal et al.
7,350,601 B2 4/2008 Belnap et al.
7,360,612 B2 4/2008 Chen et al.
7,377,341 B2 5/2008 Middlemiss et al.
7,387,177 B2 6/2008 Zahradnik et al.
7,392,862 B2 7/2008 Zahradnik et al.
7,398,837 B2 7/2008 Hall et al.
7,416,036 B2 8/2008 Forstner et al.
7,435,478 B2 10/2008 Keshavan
7,458,430 B2 12/2008 Fyfe
7,462,003 B2 12/2008 Middlemiss
7,473,287 B2 1/2009 Belnap et al.
7,493,973 B2 2/2009 Keshavan et al.
7,517,589 B2 4/2009 Eyre
7,533,740 B2 5/2009 Zhang et al.
7,559,695 B2 7/2009 Sexton et al.
7,568,534 B2 8/2009 Griffin et al.
7,621,346 B1 11/2009 Trinh et al.
7,621,348 B2 11/2009 Hoffmaster et al.
7,647,991 B2 1/2010 Felderhoff
7,703,556 B2 4/2010 Smith et al.
7,703,557 B2 4/2010 Durairajan et al.
7,819,208 B2 10/2010 Pessier et al.
7,836,975 B2 11/2010 Chen et al.
7,845,435 B2 12/2010 Zahradnik et al.
7,845,437 B2 12/2010 Bielawa et al.
7,847,437 B2 12/2010 Chakrabarti et al.
7,992,658 B2 8/2011 Buske
8,028,769 B2 10/2011 Pessier et al.
8,056,651 B2 11/2011 Turner
8,177,000 B2 5/2012 Bhome et al.
8,201,646 B2 6/2012 Vezirian
8,302,709 B2 11/2012 Bhome et al.
8,356,398 B2 1/2013 McCormick et al.
8,950,514 B2 2/2015 Buske
2001/0000885 A1 5/2001 Beuershausen et al.
2001/0030066 A1 10/2001 Clydesdale et al.
2002/0092684 A1 7/2002 Singh et al.
2002/0100618 A1 8/2002 Watson et al.
2002/0108785 A1 8/2002 Slaughter, Jr. et al.
2004/0031625 A1 2/2004 Lin et al.
2004/0099448 A1 5/2004 Fielder et al.
2004/0238224 A1 12/2004 Runia
2005/0087370 A1 4/2005 Ledgerwood, III et al.
2005/0103533 A1 5/2005 Sherwood, Jr. et al.
2005/0167161 A1 8/2005 Aaron
2005/0178587 A1 8/2005 Witman, IV et al.
2005/0183892 A1 8/2005 Oldham et al.
2005/0252691 A1 11/2005 Bramlett et al.
2005/0263328 A1 12/2005 Middlemiss
2005/0273301 A1 12/2005 Huang
2006/0027401 A1 2/2006 Nguyen
2006/0032674 A1 2/2006 Chen et al.
2006/0032677 A1 2/2006 Azar et al.
2006/0162969 A1 7/2006 Belnap et al.
2006/0196699 A1 9/2006 Estes et al.
2006/0254830 A1 11/2006 Radtke
2006/0266558 A1 11/2006 Middlemiss et al.
2006/0266559 A1 11/2006 Keeshavan et al.
2006/0283640 A1 12/2006 Estes et al.
2007/0029114 A1 2/2007 Middlemiss

(56) References Cited

U.S. PATENT DOCUMENTS

| | | | | |
|---|---|---|---|---|
| 2007/0034414 | A1 | 2/2007 | Singh et al. | |
| 2007/0046119 | A1 | 3/2007 | Cooley | |
| 2007/0062736 | A1 | 3/2007 | Cariveau et al. | |
| 2007/0079994 | A1 | 4/2007 | Middlemiss | |
| 2007/0084640 | A1 | 4/2007 | Singh | |
| 2007/0131457 | A1 | 6/2007 | McDonough et al. | |
| 2007/0187155 | A1 | 8/2007 | Middlemiss | |
| 2007/0221417 | A1 | 9/2007 | Hall et al. | |
| 2007/0227781 | A1 | 10/2007 | Cepeda et al. | |
| 2007/0272445 | A1 | 11/2007 | Cariveau | |
| 2008/0028891 | A1 | 2/2008 | Calnan et al. | |
| 2008/0029308 | A1 | 2/2008 | Chen | |
| 2008/0066970 | A1 | 3/2008 | Zahradnik et al. | |
| 2008/0087471 | A1 | 4/2008 | Chen et al. | |
| 2008/0093128 | A1 | 4/2008 | Zahradnik et al. | |
| 2008/0156543 | A1 | 7/2008 | McDonough et al. | |
| 2008/0164069 | A1 | 7/2008 | McDonough et al. | |
| 2008/0264695 | A1 | 10/2008 | Zahradnik et al. | |
| 2008/0296068 | A1 | 12/2008 | Zahradnik et al. | |
| 2008/0308320 | A1 | 12/2008 | Kolachalam | |
| 2009/0044984 | A1 | 2/2009 | Massey et al. | |
| 2009/0114454 | A1 | 5/2009 | Belnap et al. | |
| 2009/0120693 | A1 | 5/2009 | McClain et al. | |
| 2009/0126998 | A1 | 5/2009 | Zahradnik et al. | |
| 2009/0159338 | A1 | 6/2009 | Buske | |
| 2009/0159341 | A1 | 6/2009 | Pessier et al. | |
| 2009/0166093 | A1 | 7/2009 | Pessier et al. | |
| 2009/0178855 | A1 | 7/2009 | Zhang et al. | |
| 2009/0178856 | A1 | 7/2009 | Singh et al. | |
| 2009/0183925 | A1 | 7/2009 | Zhang et al. | |
| 2009/0236147 | A1 | 9/2009 | Koltermann et al. | |
| 2009/0272582 | A1 | 11/2009 | McCormick et al. | |
| 2009/0283332 | A1 | 11/2009 | Dick et al. | |
| 2010/0012392 | A1 | 1/2010 | Zahradnik et al. | |
| 2010/0018777 | A1* | 1/2010 | Pessier | E21B 10/14 175/350 |
| 2010/0043412 | A1 | 2/2010 | Dickinson et al. | |
| 2010/0155146 | A1 | 6/2010 | Nguyen et al. | |
| 2010/0218999 | A1* | 9/2010 | Jones | E21B 10/55 175/413 |
| 2010/0224417 | A1 | 9/2010 | Zahradnik et al. | |
| 2010/0252326 | A1 | 10/2010 | Bhome et al. | |
| 2010/0276205 | A1 | 11/2010 | Oxford et al. | |
| 2010/0288561 | A1 | 11/2010 | Zahradnik et al. | |
| 2010/0319993 | A1 | 12/2010 | Bhome et al. | |
| 2010/0320001 | A1 | 12/2010 | Kulkarni | |
| 2011/0024197 | A1 | 2/2011 | Centala et al. | |
| 2011/0079440 | A1 | 4/2011 | Buske et al. | |
| 2011/0079441 | A1 | 4/2011 | Buske et al. | |
| 2011/0079442 | A1 | 4/2011 | Buske et al. | |
| 2011/0079443 | A1 | 4/2011 | Buske et al. | |
| 2011/0085877 | A1 | 4/2011 | Osborne, Jr. | |
| 2011/0108326 | A1* | 5/2011 | Jones | E21B 10/43 175/57 |
| 2011/0162893 | A1* | 7/2011 | Zhang | E21B 10/08 175/428 |
| 2011/0315452 | A1* | 12/2011 | Buske | E21B 10/14 175/336 |
| 2012/0111638 | A1 | 5/2012 | Nguyen et al. | |
| 2012/0205160 | A1 | 8/2012 | Ricks et al. | |
| 2013/0341101 | A1* | 12/2013 | Durairajan | E21B 10/602 175/429 |
| 2015/0152687 | A1 | 6/2015 | Nguyen et al. | |
| 2015/0197992 | A1 | 7/2015 | Ricks et al. | |

FOREIGN PATENT DOCUMENTS

| | | |
|---|---|---|
| EP | 0157278 | 11/1989 |
| EP | 0391683 | 1/1996 |
| EP | 0874128 | 10/1998 |
| EP | 2089187 | 8/2009 |
| GB | 2183694 | 6/1987 |
| GB | 2194571 | 3/1988 |
| GB | 2364340 | 1/2002 |
| GB | 2403313 | 12/2004 |
| JP | 2001-159289 | 6/2001 |
| JP | 2001159289 | 6/2001 |
| SU | 1331988 | 8/1987 |
| WO | 8502223 | 5/1985 |
| WO | 2008124572 | 10/2008 |
| WO | 2009135119 | 11/2009 |
| WO | 2010127382 | 11/2010 |
| WO | 2010135605 | 11/2010 |
| WO | 2015102891 | 7/2015 |

OTHER PUBLICATIONS

Dantinne, P, Written Opinion for International Patent Application No. PCT/US2015/032230, European Patent Office, dated Nov. 16, 2015.

Baharlou, International Preliminary Report of Patentability for International Patent Application No. PCT/US2009/050672, The International Bureau of WIPO, dated Jan. 25, 2011.

Becamel, International Preliminary Report on Patentability for the International Patent Application No. PCT/US2010/039100, The International Bureau of WIPO, Switzerland, dated Jan. 5, 2012.

Beijer, International Preliminary Report on Patentability for International Patent Application No. PCT/US2009/042514 The International Bureau of WIPO, dated Nov. 2, 2010.

Buske, et al., "Performance Paradigm Shift: Drilling Vertical and Directional Sections Through Abrasive Formations with Roller Cone Bits", Society of Petroleum Engineers—SPE 114975 CIPC/SPE Gas Technology Symposium 2008 Joint Conference Canada, dated Jun. 16-19, 2008.

Choi, International Search Report for International Patent Application No. PCT/US2010/0039100, Korean Intellectual Property Office, dated Jan. 25, 2011.

Choi, Written Opinion for International Patent Application No. PCT/US2010/039100, Korean Intellectual Property Office, dated Jan. 25, 2011.

Dr. Wells, et al., "Bit Balling Mitigation in PDC Bit Design", International Association of Drilling Contractors/ Society of Petroleum Engineers—IADC/SPE 114673 IADC/SPE Asia Pacific Drilling Technology Conference and Exhibition Indonesia, dated Aug. 25-27, 2008.

Ersoy, et al., "Wear characteristics of PDC pin and hybrid core bits in rock drilling", Wear 188 Elsevier Science S.A., pp. 150-165, dated Mar. 1995.

George, et al., "Significant Cost Savings Achieved Through Out the Use of PDC Bits in Compressed Air/Foam Applications", Society of Petroleum Engineers—SPE 116118 2008 SPE Annual Technical Conference and Exhibition Denver, Colorado, dated Sep. 21-24, 2008.

Georgescu, Written Opinion for International Patent Application No. PCT/US2010/051020, European Patent Office dated Jun. 1, 2011.

Georgescu, International Search Report for International Patent Application No. PCT/US2010/050631, European Patent Office dated Jun. 10, 2011.

Georgescu, Written Opinion for International Patent Application No. PCT/US2010/050631, European Patent Office dated Jun. 10, 2011.

Georgescu, International Search Report for International Patent Application No. PCT/US2011/042437, European Patent Office dated Nov. 9, 2011.

Georgescu, Written Opinion for International Patent Application No. PCT/US2011/042437, European Patent Office dated Nov. 9, 2011.

Georgescu, International Search Report for International Patent Application No. PCT/US2010/051020, European Patent Office, dated Jun. 1, 2011.

Georgescu, International Search Report for International Patent Application No. PCT/US2010/051019, European Patent Office, dated Jun. 6, 2011.

Georgescu, Written Opinion for International Patent Application No. PCT/US2010/051019, European Patent Office, dated Jun. 6, 2011.

(56) References Cited

OTHER PUBLICATIONS

Georgescu, International Search Report for International Patent Application No. PCT/US2010/051017, European Patent Office, dated Jun. 8, 2011.
Georgescu, Written Opinion for International Patent Application No. PCT/US2010/051017, European Patent Office, dated Jun. 8, 2011.
Georgescu, International Search Report for International Patent Application No. PCT/US2010/051014, European Patent Office dated Jun. 9, 2011.
Georgescu, Written Opinion for International Patent Application No. PCT/US2010/051014, European Patent Office, dated Jun. 9, 2011.
Kang, International Search Report for International Patent Application No. PCT/US2010/033513, Korean Intellectual Property Office, dated Jan. 10, 2011.
Kang, Written Opinion for International Patent Application No. PCT/US2010/033513, Korean Intellectual Property Office, dated Jan. 10, 2011.
Kang, International Search Report for International Patent Application No. PCT/US2010/032511, Korean Intellectual Property Office, dated Jan. 17, 2011.
Kang, Written Opinion for International Patent Application No. PCT/US2010/032511, Korean Intellectual Property Office, dated Jan. 17, 2011.
Kim, International Search Report for International Patent Application No. PCT/US2009/067969, Korean Intellectual Property Office, dated May 25, 2010.
Kim, Written Opinion for International Patent Application No. PCT/US2009/067969, Korean Intellectual Property Office, dated May 25, 2010.
Lee, International Search Report for International Patent Application No. PCT/US2009/042514, Korean Intellectual Property Office dated Nov. 27, 2009.
Lee, Written Opinion for International Patent Application No. PCT/US2009/042514, Korean Intellectual Property Office dated Nov. 27, 2009.
Williams, et al., "An Analysis of the Performance of PDC Hybrid Drill Bits", SPE/IADC 16117, SPE/IADC Drilling Conference, pp. 585-594, dated Mar. 1987.
Lee, International Search Report for International Patent Application No. PCT/US2009/050672, Korean Intellectual Property Office dated Mar. 3, 2010.
Warren, et al., "PDC Bits: What's Needed to Meet Tomorrow's Challenge", SPE 27978, University of Tulsa Centennial Petroleum Engineering Symposium, pp. 207-214, dated Aug. 1994.
Lee, Written Opinion for International Patent Application No. PCT/US2009/050672, Korean Intellectual Property Office dated Mar. 3, 2010.
Tomlinson, et al., "Rock Drilling—Syndax3 Pins—New Concepts in PCD Drilling", Industrial Diamond Review, pp. 109-114, dated Mar. 1992.
Mills Machine Company, "Rotary Hole Openers—Section 8", Retrieved from the internet on May 7, 2009 using <URL: http://www.millsmachine.com/pages/home_page/mills_catalog/cat_holeopen/cat_holeopen.pdf>.
Ott, International Search Report for International Patent Application No. PCT/US2010/049159, European Patent Office, dated Apr. 21, 2011.
Ott, Written Opinion for International Patent Application No. PCT/US2010/049159, European Patent Office, dated Apr. 21, 2011.
Smith Services, "Hole Opener—Model 6980 Hole Opener", Retrieved from the internet on May 7, 2008 using <URL http://www.siismithservices.com/b_products/product_page.asp?ID=589>.
Pessier, et al., "Hybrid Bits Offer Distinct Advantages in Selected Roller Cone and PDC Bit Applications", IADC/SPE Paper No. 128741, dated Feb. 2-4, 2010, pp. 1-9.
Schneiderbauer, International Search Report for International Patent Application No. PCT/US2012/024134, European Patent Office, dated Mar. 7, 2013.
Schneiderbauer, International Written Opinion for International Patent Application No. PCT/US2012/024134, European Patent Office, dated Mar. 7, 2013.
Schouten, International Search Report for International Patent Application No. PCT/US2008/083532 European Patent Office, dated Feb. 25, 2009.
Schouten, Written Opinion for International Patent Application No. PCT/US2008/083532, European Patent Office dated Feb. 25, 2009.
Sheppard, et al., "Rock Drilling—Hybrid Bit Success for Syndax3 Pins", Industrial Diamond Review, pp. 309-311, dated Jun. 1993.
Thomas, S., International Search Report for International Patent Application No. PCT/US2015/014011, USPTO, dated Apr. 24, 2015.
Thomas, S., Written Opinion for International Patent Application No. PCT/US2015/014011, USPTO, dated Apr. 24, 2015.

* cited by examiner

REVERSE CIRCULATION HYBRID BIT

CROSS-REFERENCE TO RELATED APPLICATION

This application claims priority to and benefit of U.S. Provisional Application Ser. No. 62/066,324, filed on Oct. 20, 2014, the contents of which are incorporated herein by reference for all purposes.

BACKGROUND OF THE INVENTION

Field of the Invention

The embodiments disclosed and taught herein relates generally to hybrid drill bits having at least one fixed blade and at least one rolling cutter assembly and, more specifically, relates to a hybrid drill bit configured for reverse circulation.

Description of the Related Art

Rotary earth-boring bits useful for oil and gas exploration and production have evolved considerably since the bi-cone bit developed by Howard R. Hughes, Sr., which had two rotatable cone-shaped cutting elements. Today, there are rotary bits with fixed or non-rotating blades with polycrystalline diamond cutters (PDC) mounted thereon. There are also rotary hybrid drill bits combining fixed-blade cutting elements and rotating cutting elements. Most, but not all hybrid bits are modular in construction, in that the rotatable or rolling cutter elements are separate components coupled to the bit body by welding or other type of fastening.

Usually, the cuttings from the bottom and sides of the borehole are removed by drilling fluid (a liquid) that is pumped downhole from the surface. The cuttings are entrained in the fluid and carried by the drilling fluid to the surface for removal and disposal. Typically, the circulation path involves pumping drilling fluid down the hollow center pipe or drill string, forcing the fluid through jets or orifices in the drill bit to wash away the cuttings, and returning the cuttings-ladened fluid to the surface through the annulus.

It is also known to use a "reverse" circulation path in which the drilling fluid is pumped down the annulus to the drill bit where the cuttings are entrained in the fluid and the fluid is returned to the surface through the hollow drill pipe. Reverse circulation requires that the drill bit be configured specifically to allow the cuttings-ladened fluid to pass through to the drill pipe. While reverse circulation has been used successfully with rotating cutter rotary bits, configuring a fixed-blade bit or hybrid bit for reverse circulation presents numerous issues not present in rotating cutter rotary bits, which issues have not heretofore been overcome.

The embodiments disclosed and taught herein is directed to an improved modular hybrid bit configured for reverse circulation.

BRIEF SUMMARY OF THE INVENTION

As a brief summary of one of the many embodiments of the present disclosures, a hybrid drill bit may comprise a body having at least one blade, each blade comprising a plurality of earth formation cutting elements; at least one rolling cutter assembly having a head onto which a cutter element is rotatably coupled; and a reverse circulation system adjacent a lower portion of the bit body and is configured to allow cuttings to pass therethrough and configured to maximize the load bearing capacity of the bit.

Other and further summaries of the disclosure are presented in the drawings, the text and the appended claims.

BRIEF DESCRIPTION OF THE DRAWINGS

The following figures form part of the present specification and are included to demonstrate further certain aspects of the present disclosure. The disclosure may be better understood by reference to one or more of these figures in combination with the detailed description of specific embodiments presented herein.

Figure 1:
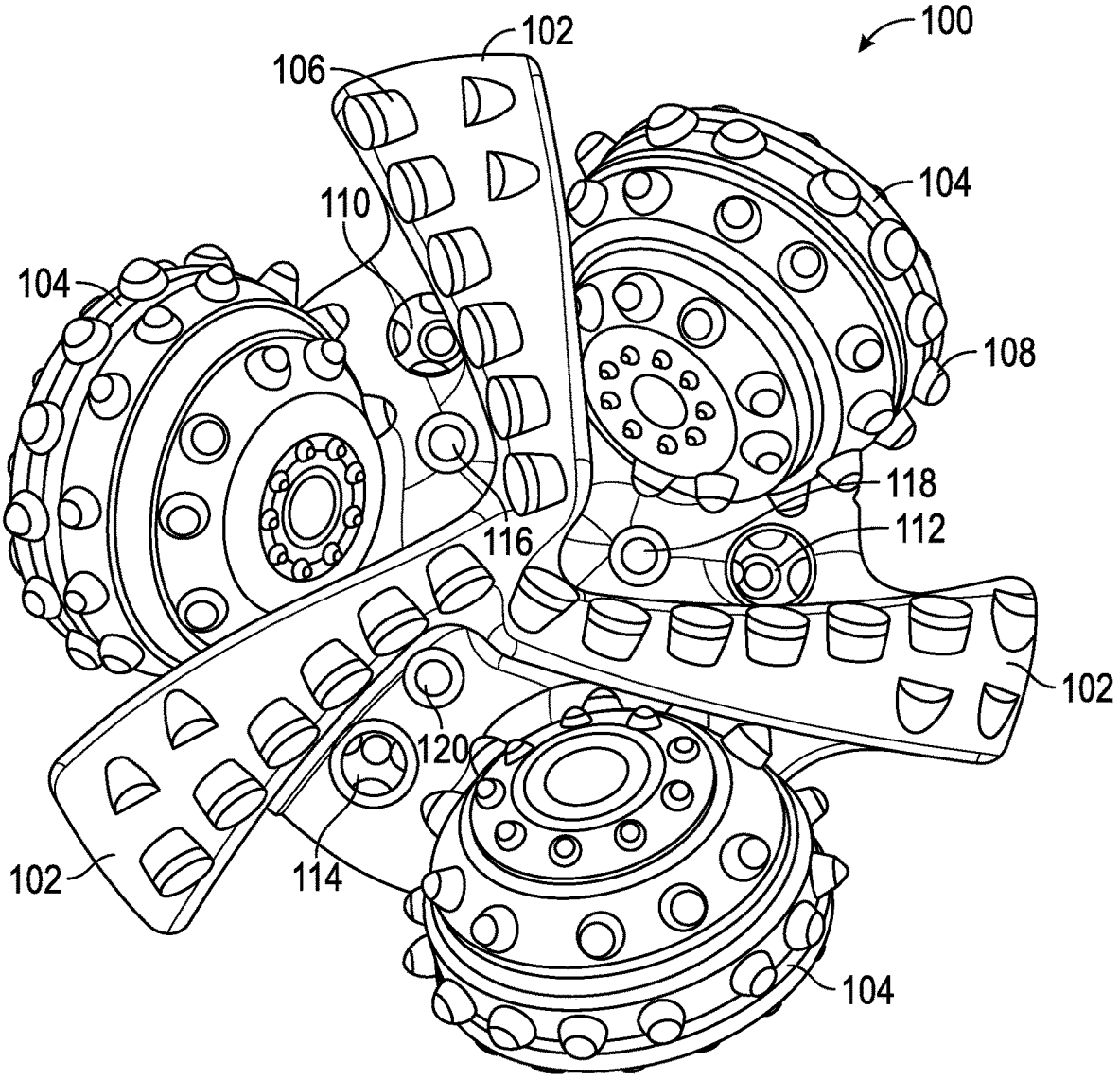
FIG. 1 illustrates an end view of a typical hybrid rotary drill bit configured for conventional, or forward, circulation.

While the embodiments disclosed herein is susceptible to various modifications and alternative forms, only a few specific embodiments have been shown by way of example in the drawings and are described in detail below. The figures and detailed descriptions of these specific embodiments are not intended to limit the breadth or scope of the inventive concepts or the appended claims in any manner. Rather, the figures and detailed written descriptions are provided to illustrate the inventive concepts to a person of ordinary skill in the art and to enable such person to make and use the inventive concepts.

DETAILED DESCRIPTION

The figures described above and the written description of specific structures and functions below are not presented to limit the scope of what Applicants have invented or the scope of the appended claims. Rather, the figures and written description are provided to teach any person skilled in the art to make and use the disclosures for which patent protection is sought. Those skilled in the art will appreciate that not all features of a commercial embodiment of the disclosures are described or shown for the sake of clarity and understanding. Persons of skill in this art will also appreciate that the development of an actual commercial embodiment incorporating aspects of the present disclosures will require numerous implementation-specific decisions to achieve the developer's ultimate goal for the commercial embodiment. Such implementation-specific decisions may include, and likely are not limited to, compliance with system-related, business-related, government-related and other constraints, which may vary by specific implementation, location and from time to time. While a developer's efforts might be complex and time-consuming in an absolute sense, such efforts would be, nevertheless, a routine undertaking for those of skill in this art having benefit of this disclosure. It must be understood that the embodiments disclosed and taught herein is susceptible to numerous and various modifications and alternative forms. Lastly, the use of a singular term, such as, but not limited to, "a," is not intended as limiting of the number of items. Also, the use of relational terms, such as, but not limited to, "top," "bottom," "left," "right," "upper," "lower," "down," "up," "side," and the like, are used in the written description for clarity in specific reference to the figures and are not intended to limit the scope of the disclosure or the appended claims.

Embodiments of the present disclosure include a hybrid drill bit comprising a single or a plurality of fixed blades, at least one of which comprises a cutting element, and a single or a plurality of rolling cutter assemblies, at least one of which comprises a cutting element. A fluid pathway system adjacent the longitudinal axis of the bit is configured and provided to allow drilling cuttings to flow from the borehole through the fluid pathway system and into the drill pipe. The fluid pathway system may comprise a single, centralized opening, such as a circle or an ellipse in cross section. Alternatively, the fluid pathway system may comprise a plurality of openings of undetermined or determined shape, located on or about the longitudinal axis. In any of the embodiments, the opening(s) may be substantially planar (i.e., substantially two-dimensional) or three-dimensional, in that the opening(s) may have a longitudinal aspect to its shape. As taught herein, the fluid pathway systems may be designed and implemented in such fashion to maximize both the load bearing capacity of the drill bit and the flow area of the fluid pathway system. It will be appreciated that with this disclosure, fluid flow comes from the surrounding annulus, washes through the junk slots and enters the fluid pathway system on its way to the surface. The transition between the junk slots and the fluid pathway system may comprise hardfacing or other material systems configured to provide erosion resistance.

Turning now to FIG. 1, illustrated is a hybrid rotary drill bit 100 configured for forward circulation. Drill bit 100 may comprise a fixed blade 102 and a rolling cutter assembly 104. As illustrated in FIG. 1, the drill bit 100 has three fixed blades 102 and three rolling cutter assemblies 104. Fixed blade 102 may have at least one and preferably multiple cutting elements 106. Similarly, the rolling cutter assembly 104 may have at least one and preferably multiple cutting elements 108. It will be appreciated that the term "cutting element" is used, even though the process by which formation material is removed is not technically by "cutting." Cutting elements 106 and 108 comprise all those elements known in the art to aid the removal of formation material regardless of the process used including, but not limited to, cutting, shearing and crushing processes. Because drill bit 100 is configured for forward circulation, drill bit 100 comprises one or more fluid nozzles 110 and one or more fluid ports 116 adapted to allow drilling fluid (not shown) to pass therethrough and wash away drilling cuttings. FIG. 1 illustrates nozzles 110, 112 and 114 and ports 116, 118 and 120. For example, three ports are shown, each having a diameter of about 7/16 of an inch (about 0.15 $in^2$). Three nozzles are also shown, each having a diameter of about 5/8 of an inch (about 0.31 $in^2$).

Figure 2:
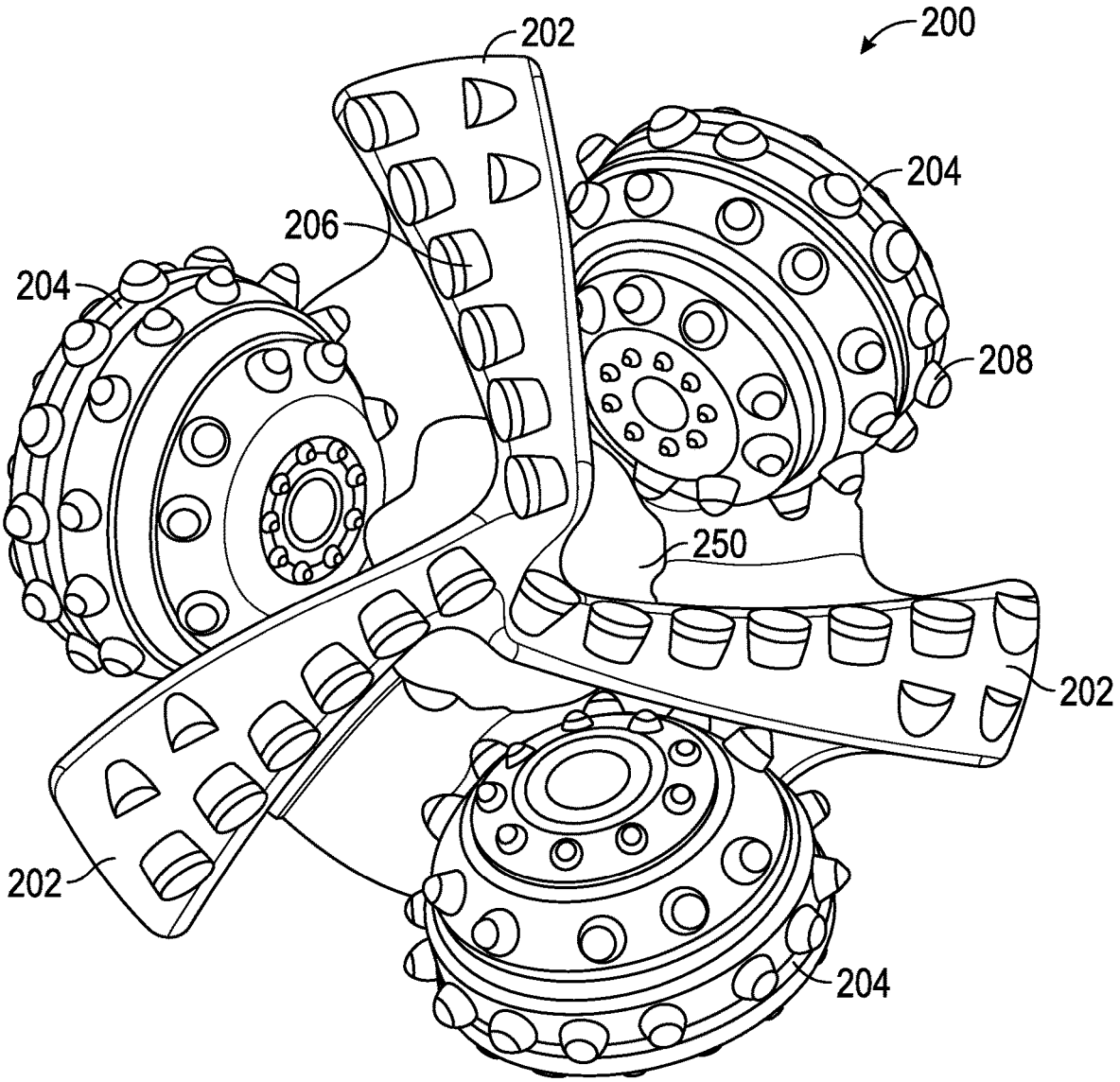
FIG. 2 illustrates a hybrid rotary drill bit configured for reverse circulation according to the present disclosure.

FIG. 2 illustrates a hybrid rotary drill bit 200 configured according to the present disclosure for reverse circulation. The drill bit 200 comprises at least one fixed blade 202 on which at least one cutting element 206, preferably, is located. The drill bit 200 also comprises at least one rolling cutter assembly 204, which preferably comprises at least one cutting element 208. Comparing drill bit 100 in FIG. 1 to drill bit 200 in FIG. 2, drill bit 200 does not utilize fluid nozzles 110 or fluid ports 116. Instead, drill bit 200 comprises a reverse circulation fluid pathway system 250, which in this embodiment preferably comprises a substantially round and substantially planar opening in the bit body substantially centered about the longitudinal axis of the bit 200. As an example of a particular embodiment, for a nominal 10-inch diameter drill bit, the fluid pathway system 250 may comprise an opening having an effective or average diameter of about 3 inches. Alternatively, the fluid pathway system 250 may have a cross-sectional area substantially the same as or larger than the drill bit shank bore (not shown). It will be appreciated that the fluid pathway system 250 is defined underneath the junction of the fixed blades 202. In other words, a portion of the fixed blades 202 adjacent the longitudinal axis may be cantilevered over the fluid pathway system 250.

Figure 3:
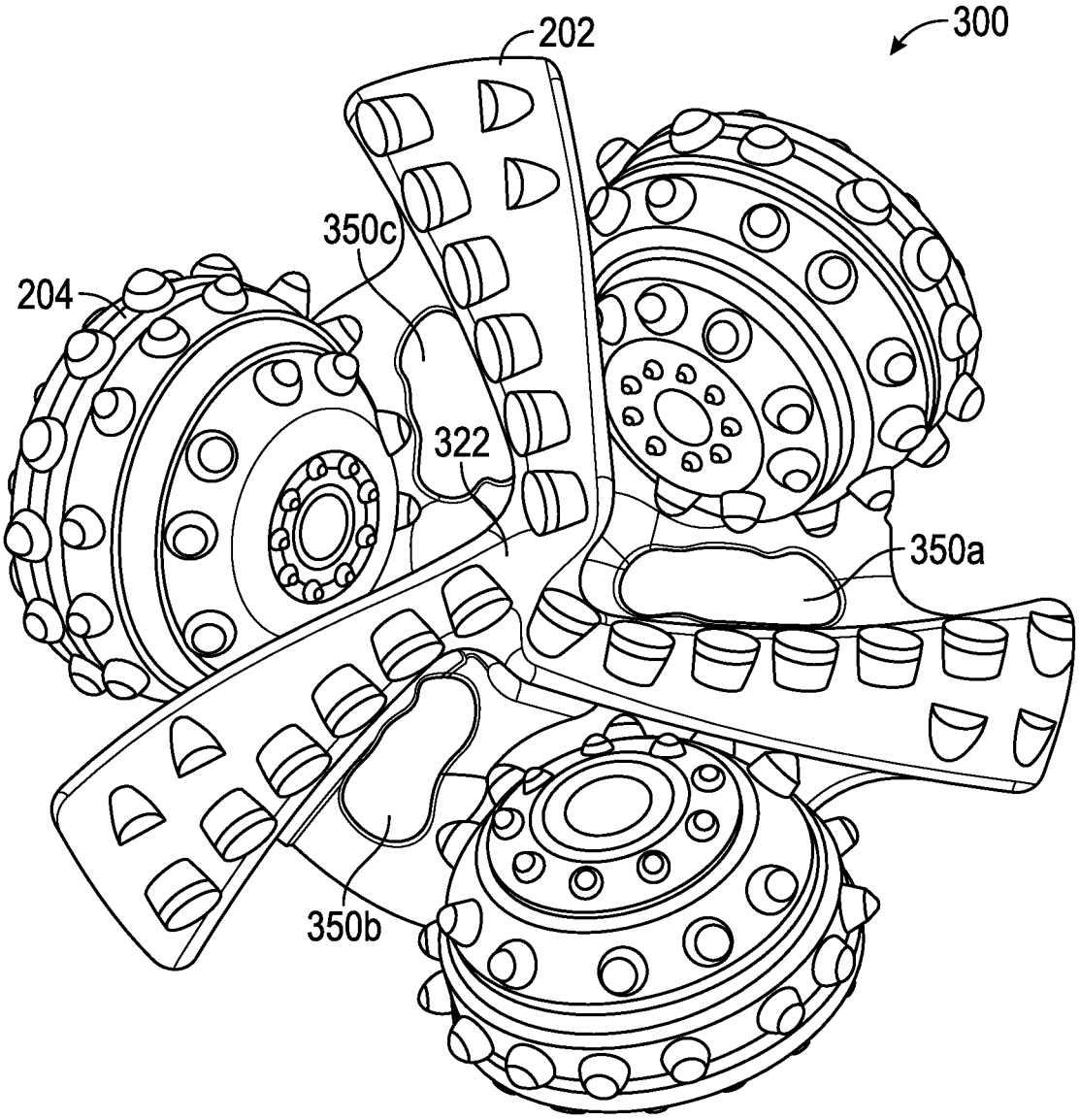
FIG. 3 illustrates another possible embodiment of a hybrid rotary drill bit configured for reverse circulation according to the present disclosure.

FIG. 3 illustrates another hybrid rotary drill bit 300 configured according to the present disclosure for reverse circulation. The drill bit 300 comprises at least one fixed blade 202 on which at least one cutting element 206, preferably, is located. The drill bit 300 also comprises at least one rolling cutter assembly 204, which preferably comprises at least one cutting element 208. Drill bit 300 comprises a reverse circulation fluid pathway system 350 comprising three slots 350*a*, 350*b* and 350*c*. Each of these portions may have a slot-like shape as illustrated, and in the embodiment illustrated in FIG. 3 are approximately 1 inch wide by about 2 inches long. Unlike the drill bit illustrated in FIG. 2, the drill bit of FIG. 3 provides blade 202 support at the bit center 322. It will be understood that fluid pathway slots 350*a*, 350*b* and 350*c* converge into fluid communication with each other and with the bit shank bore (not shown) inside the bit body.

Figure 4:
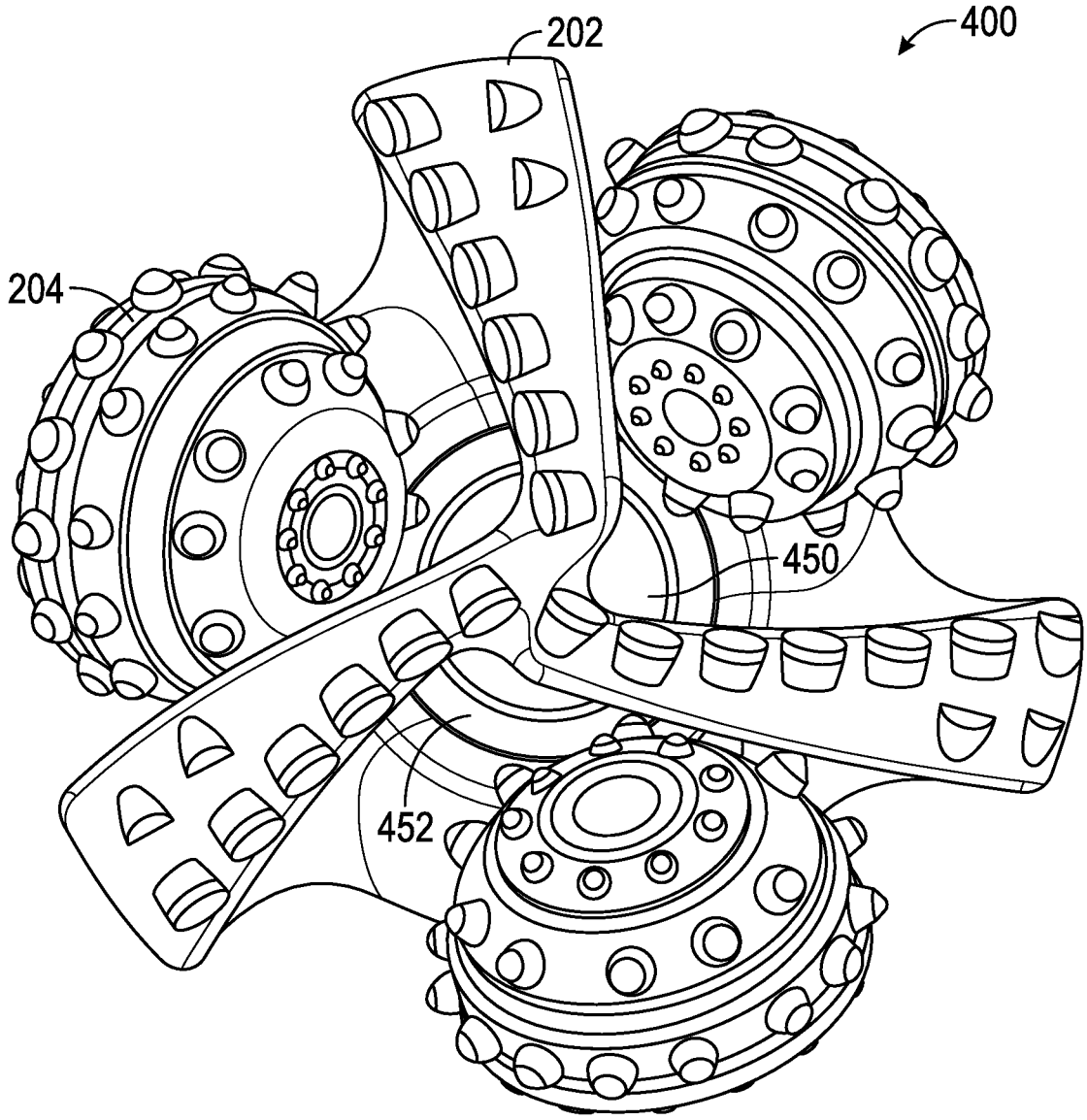
FIG. 4 illustrates another possible embodiment of a hybrid rotary drill bit configured for reverse circulation according to the present disclosure.

FIG. 4 illustrates yet another a hybrid rotary drill bit 400 configured according to the present disclosure for reverse circulation. The drill bit 400 comprises at least one fixed blade 202 on which at least one cutting element 206, preferably, is located. The drill bit 400 also comprises at least one rolling cutter assembly 204, which preferably comprises at least one cutting element 208. Drill bit 400 comprises a reverse circulation fluid pathway system 450 comprising a substantially round and planar opening, similar to fluid pathway system 250 in FIG. 2. However, the fluid pathway system 450 comprises a replaceable insert 452 adapted to resist erosive wear of the cuttings-ladened fluid passing therethrough. As with the drill bit 200 illustrated in FIG. 2, the cross-sectional area of the fluid pathway system 450 is substantially equal to or greater than the cross-sectional area of the bit bore shank.

Figure 5:
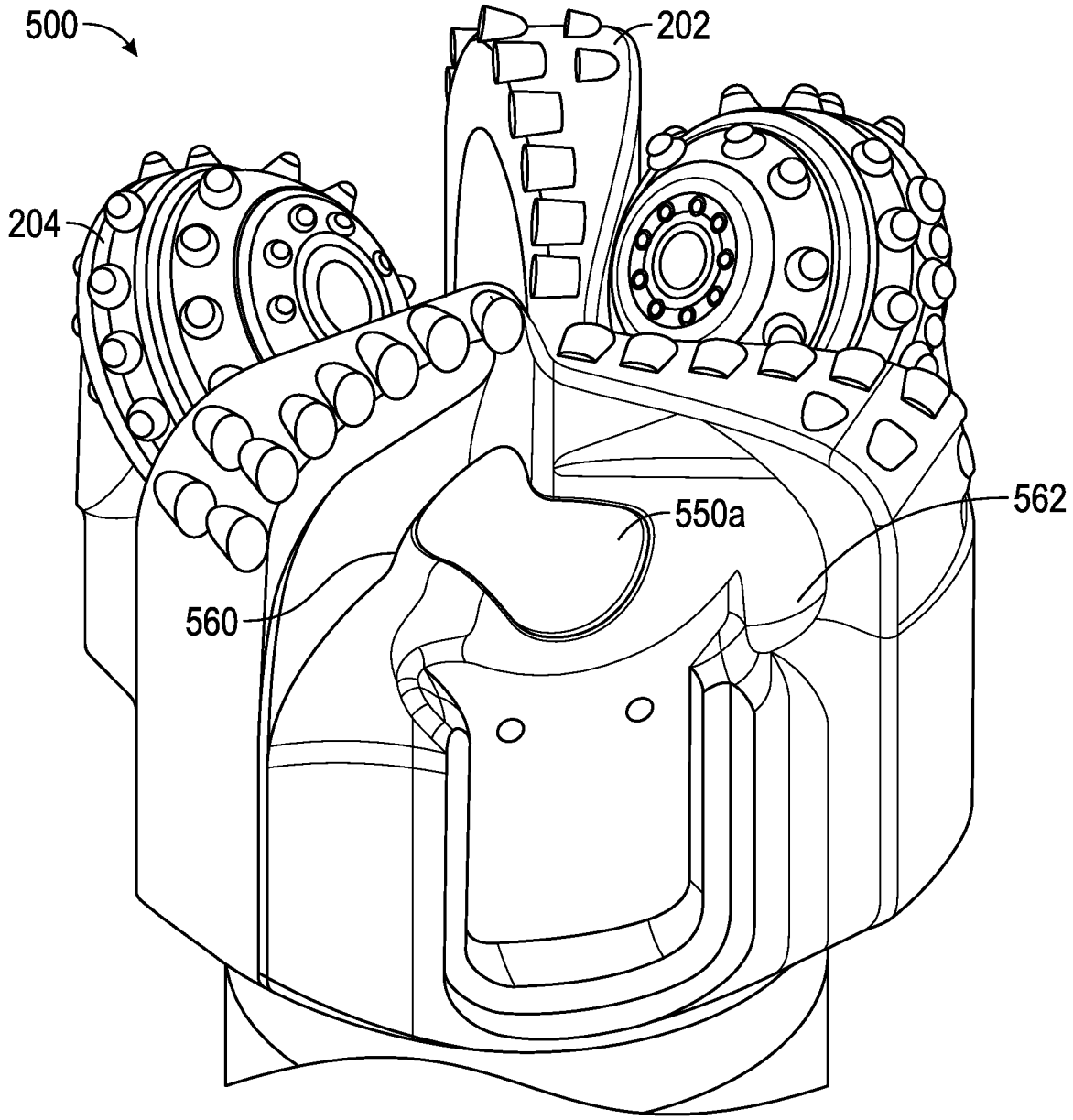
FIG. 5 illustrates another possible embodiment of a hybrid rotary drill bit configured for reverse circulation according to the present disclosure.

FIG. 5 illustrates a hybrid rotary drill bit 500 configured according to the present disclosure for reverse circulation. The drill bit 500 comprises at least one fixed blade 202 on which at least one cutting element 206, preferably, is located. The drill bit 500 also comprises at least one rolling cutter assembly 204, which preferably comprises at least one cutting element 208. Drill bit 500 comprises a reverse circulation fluid pathway system 550 comprising a substantially centralized opening, such as described for drill bit 200 in FIG. 2. In FIG. 5, one of the rolling cutter assemblies has been removed to show that portion 550*a* of fluid pathway system 550. In this view, junk slots 560 and 562 are readily visualized. This view also shows how fixed blades 202 may be configured to both maximize the reverse circulation flow area and maximize blade strength.

Figure 6:
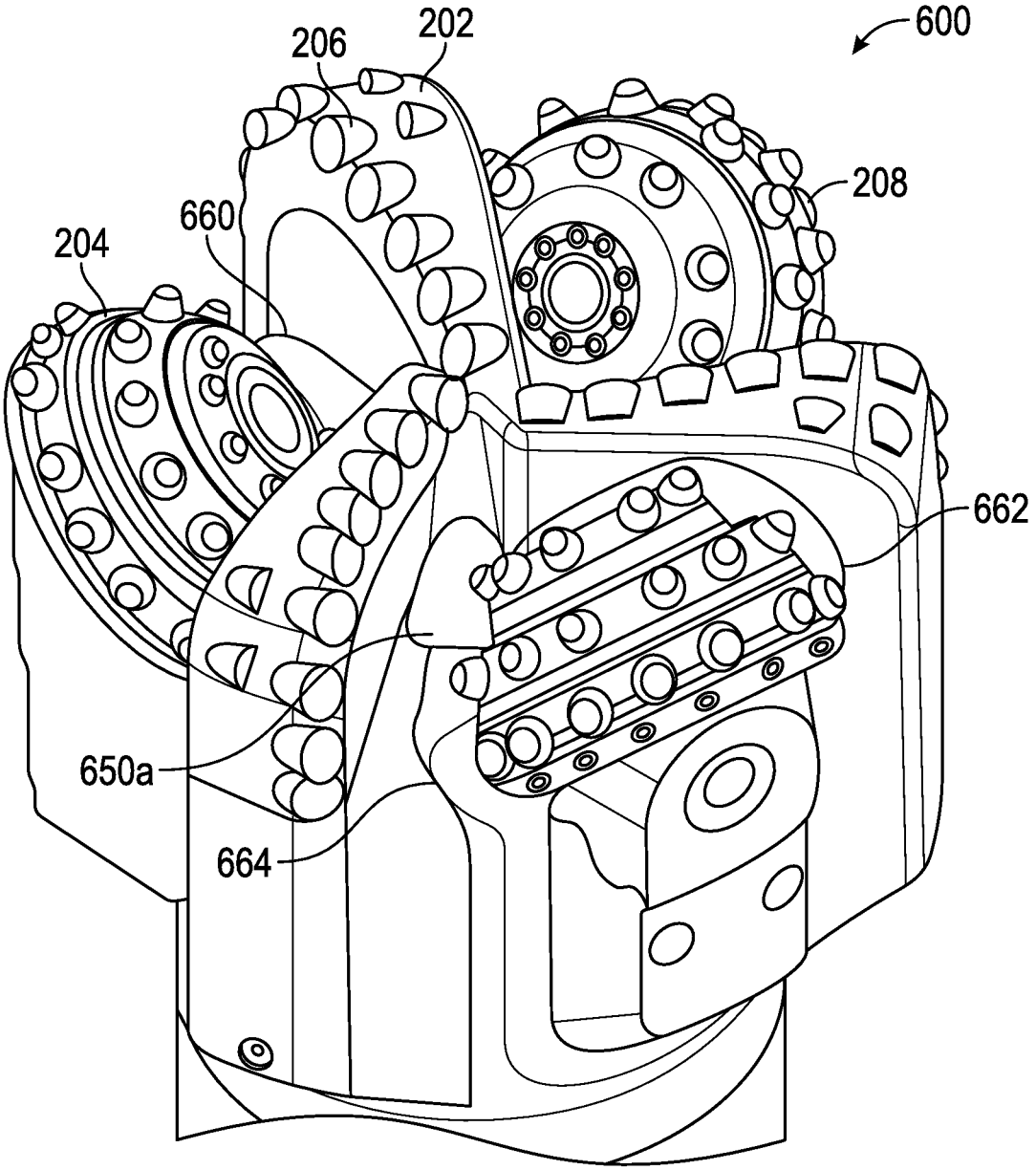
FIG. 6 illustrates another possible embodiment of a hybrid rotary drill bit configured for reverse circulation according to the present disclosure.

FIG. 6 illustrates a hybrid rotary drill bit 600 configured according to the present disclosure for reverse circulation. The drill bit 600 comprises at least one fixed blade 202 on which at least one cutting element 206, preferably, is located. The drill bit 600 also comprises at least one rolling cutter assembly 204, which preferably comprises at least one cutting element 208. Drill bit 600 comprises a reverse circulation fluid pathway system 650 comprising a substantially centralized opening, such as described for drill bit 200 in FIG. 2. In FIG. 6, one of the rolling cutter assemblies has been displaced to show that portion 650*a* of fluid pathway system 650. In this view, junk slots 660, 662 and 664 are seen. As can be appreciated from this FIG. 6 and FIGS. 2-5 the hybrid bit of this disclosure may utilize modules, such as removable rolling cutter assemblies 204. Also, the materials from which the bit body may be constructed can include steel, matrix materials and combinations.

All of the many possible embodiments of the disclosure described herein may comprise modular rolling cutter assemblies that may be affixed to the bit body by mechanical fasteners, such as bolts or studs and nuts, or by chemical or metallurgical means, such as welding, brazing or amorphous diffusion bonding, or a combination of such systems. Further, embodiments may comprise fixed blades having cutting elements arranged to remove formation material adjacent the bit centerline, and/or arranged to remove formation material from a cone region to a gage region of the bit. The rolling cutter assemblies may be truncated in length and position such that the rolling cutter assemblies do not have cutting elements arranged to remove formation material in the cone and nose regions. The overlay of cutting elements of the fixed blades and the rolling cutter assemblies provide a substantially continuous cutting profile from cone to gage.

Other and further embodiments utilizing one or more aspects of the disclosure described above can be devised without departing from the spirit of disclosure. Further, the various methods and embodiments of the methods of manufacture and assembly of the system, as well as location specifications, can be included in combination with each other to produce variations of the disclosed methods and embodiments. For example, although the embodiments illustrated herein are symmetrical in that each bit has the same number of fixed-blades as rolling cutter assemblies, the disclosure contemplates an asymmetrical arrangement of fixed and rolling cutter assemblies. Discussion of singular elements can include plural elements and vice-versa.

The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions.

The disclosures have been described in the context of preferred and other embodiments and not every embodiment of the disclosure has been described.

Obvious modifications and alterations to the described embodiments are available to those of ordinary skill in the art. The disclosed and undisclosed embodiments are not intended to limit or restrict the scope or applicability of the disclosure conceived of by the Applicants, but rather, in conformity with the patent laws, Applicants intend to fully protect all such modifications and improvements that come within the scope or range of equivalent of the following claims.

What is claimed is:

1. A hybrid drill bit comprising:

a bit body having a shank portion and at least three fixed blades;

the shank portion having a fluid bore of a predetermined cross-sectional area extending along a longitudinal axis of the shank portion;

the at least three fixed blades each comprising at least one cutting element configured to remove formation material;

the bit body having at least one rolling cutter assembly disposed adjacent the at least three fixed blades and comprising at least one cutting element configured to remove formation material;

at least one junk slot defined between at least one of the at least three fixed blades and the at least one rolling cutter assembly;

a reverse circulation fluid pathway system to allow for reverse fluid flow without utilizing any nozzles comprising a fluid flow pathway extending from the fluid bore of the shank portion to a single opening in a lower surface of the bit body, the lower surface being located axially at an interface of the at least three fixed blades and a remainder of the bit body, wherein the single opening is substantially centered on or about a longitudinal axis of the bit;

wherein the lower surface is at least substantially planar at and proximate an outer peripheral edge of the single opening; and wherein the at least three blades meet and are connected at a point centered on a longitudinal axis of the bit, and wherein each of the at least three blades is partially suspended over the single opening.

2. The hybrid drill bit of claim 1, wherein the at least one rolling cutter assembly comprises three rolling cutter assemblies.

3. The hybrid drill bit of claim 2, further wherein each of the rolling cutter assemblies are truncated such that each rolling cutter is configured to not extend into nose and cone regions.

4. The hybrid drill bit of claim 3, wherein the rolling cutter assemblies comprise a plurality of cutting elements configured to remove formation material from shoulder and gage regions, but not from the nose and cone regions.

5. The hybrid drill bit of claim 4, wherein the at least three fixed blades comprise a plurality of cutting elements configured to remove formation material from a cone region to a gage region.

6. The hybrid drill bit of claim 5, wherein the at least three fixed blades are configured with at least one cutting element configured to remove formation material adjacent a centerline of the bit.

7. The hybrid drill bit of claim 1, wherein the single opening comprises a substantially circular opening.

8. The hybrid drill bit of claim 7, wherein a wall defining the single opening comprises hardfacing to resist fluid erosion.

9. The hybrid drill bit of claim 7, wherein a wall defining the single opening comprises an erosion-resistant insert.

10. The hybrid drill bit of claim 1, wherein the single opening is at least partially located between at least one fixed blade of the at least three fixed blades and the at least one rolling cutter assembly.

11. A method of drilling a subterranean borehole comprising:

running in the borehole a reverse circulation hybrid drill bit;

pumping a drilling fluid to the bottom of the borehole through an annulus formed between a drill string and the borehole;

establishing fluid circulation between the annulus and an interior of the drill string through the drill bit;

rotating the drill bit to remove formation material;

circulating the removed formation material from the borehole bottom, through the drill bit and into the interior of the drill string; and wherein the hybrid drill bit comprises:

a bit body having a shank portion and at least three fixed blades;

the shank portion having a fluid bore of a predetermined cross-sectional area extending along a longitudinal axis of the shank portion;

the at least three fixed blades each comprising at least one cutting element configured to remove formation material;

the bit body having at least one rolling cutter assembly disposed adjacent at least one of the at least three fixed blades and comprising at least one cutting element configured to remove formation material;

at least one junk slot defined between at least one of the at least three fixed blades and the at least one rolling cutter assembly; and a reverse circulation fluid pathway system to allow for reverse fluid flow without utilizing any nozzles comprising a fluid flow pathway extending from the fluid bore of the shank portion to a single opening in a lower surface of the bit body, the lower surface being located axially at an interface of the at least three fixed blades and a remainder of the bit body, wherein the single opening is substantially centered on or about a longitudinal axis of the bit, wherein the lower surface is at least substantially planar at and proximate an outer peripheral edge of the single opening, and wherein the at least three blades meet and are connected at a point centered on the longitudinal axis of the bit, and wherein each of the at least three blades is partially suspended over the single opening.

12. A hybrid drill bit comprising:

a body comprising a shank portion and at least three fixed blades;

a fluid bore extending through the shank portion of the body and along a longitudinal axis of the body;

a reverse circulation fluid pathway system to allow for reverse fluid flow without utilizing any nozzles or comprising a fluid flow pathway extending from the fluid bore to a single opening in a lower surface of the body, the lower surface being located axially at an interface of the at least three blades and a remainder of the body, and wherein the at least three fixed blades meet and are connected at a point centered on the longitudinal axis of the body, and wherein each of the at least three blades is partially suspended over the single opening.

13. The hybrid drill bit of claim 12, wherein the single opening comprises a variable radius along a circumference of the single opening.

14. The hybrid drill bit of claim 12, further comprising a plurality of rolling cutter assemblies coupled to the body, each rolling cutting assembly being disposed between adjacent blades of the at least three fixed blades.

15. The hybrid drill bit of claim 12, wherein a wall defining the single opening comprises hardfacing to resist fluid erosion.

16. The hybrid drill bit of claim 12, wherein a wall defining the single opening comprises an erosion-resistant insert.

* * * * *